US005700525A

United States Patent [19]

Ouyang et al.

[11] Patent Number: 5,700,525

[45] Date of Patent: Dec. 23, 1997

[54] PASSIVATION METHOD AND COMPOSITION FOR GALVANIZED METAL SURFACES

[75] Inventors: Jiangbo Ouyang, Media; William L. Harpel, Langhorne, both of Pa.

[73] Assignee: BetzDearborn Inc., Trevose, Pa.

[21] Appl. No.: 594,883

[22] Filed: Feb. 7, 1996

Related U.S. Application Data

[63] Continuation-in-part of Ser. No. 412,827, Mar. 29, 1995, abandoned.

[51] Int. Cl.[6] ..... B05D 3/00; B05D 1/36

[52] U.S. Cl. ..... 427/416; 427/343; 427/388.4; 427/406

[58] Field of Search ..... 427/416, 388.4, 427/388.1, 384, 406, 343

[56] References Cited

U.S. PATENT DOCUMENTS

| | | | |
|---|---|---|---|
| 2,471,638 | 5/1949 | McCarthy | 106/14.34 |
| 2,995,532 | 8/1961 | Cantrell et al. | 106/14.34 |
| 3,839,097 | 10/1974 | Hall et al. | 427/435 |
| 3,846,170 | 11/1974 | Isawa et al. | 427/416 |
| 3,891,471 | 6/1975 | Summers et al. | 427/409 |
| 4,138,276 | 2/1979 | Miller | 427/435 |
| 4,168,255 | 9/1979 | Lewis et al. | 427/388.4 |
| 4,169,916 | 10/1979 | Tsutsui et al. | 427/388.4 |
| 4,252,859 | 2/1981 | Concannon et al. | 427/388.4 |
| 4,315,957 | 2/1982 | Hereth et al. | 427/155 |
| 4,323,602 | 4/1982 | Parker | 427/429 |
| 4,444,802 | 4/1984 | Winters et al. | 427/435 |
| 4,606,945 | 8/1986 | Itoh et al. | 106/14.34 |
| 4,610,929 | 9/1986 | Mosser et al. | 427/421 |
| 4,868,066 | 9/1989 | Whitmore | 427/242 |
| 5,011,711 | 4/1991 | Kanda et al. | 427/416 |
| 5,049,186 | 9/1991 | Kawabata | 427/155 |
| 5,081,174 | 1/1992 | Vanbuskirk | 427/156 |
| 5,252,363 | 10/1993 | Anderson | 427/388.4 |
| 5,264,028 | 11/1993 | Beshay | 106/14.36 |
| 5,300,323 | 4/1994 | Ahmed | 427/435 |
| 5,344,505 | 9/1994 | Ouyang et al. | 106/14.12 |
| 5,348,575 | 9/1994 | Müller et al. | 148/261 |
| 5,387,473 | 2/1995 | Yoshimi et al. | 428/623 |
| 5,545,483 | 8/1996 | Ouyang et al. | 427/299 |

FOREIGN PATENT DOCUMENTS

| | | | |
|---|---|---|---|
| 2506349 | 8/1976 | Germany | 148/259 |
| 3826324 | 2/1990 | Germany | 106/14.34 |
| 39-3112 | 3/1964 | Japan | 148/259 |
| 865497 | 4/1961 | United Kingdom | 148/259 |

*Primary Examiner*—Diana Dudash

*Attorney, Agent, or Firm*—Alexander D. Ricci; Steven D. Boyd

[57] ABSTRACT

Compositions and methods for passivating galvanized metal surfaces are disclosed. The addition of a paraffin wax, preferably emulsified with nonionic surfactants to commercial passivation treatment (non-chrome) enhances passivation.

4 Claims, No Drawings

PASSIVATION METHOD AND COMPOSITION FOR GALVANIZED METAL SURFACES

This application is a continuation-in-part of application Ser. No. 08/412,827 filed Mar. 29, 1995, now abandoned.

FIELD OF THE INVENTION

The present invention relates to compositions and methods for passivating a galvanized coating on a metal substrate. More particularly, the present invention relates to a composition and method for treating a galvanized or Galvalume® metal surface to inhibit corrosion, improve surface friction characteristics and enhance fingerprint resistance.

BACKGROUND OF THE INVENTION

The purposes of the formation of conversion coatings on galvanized metal surfaces are to provide corrosion resistance, improve adhesion of coatings and for aesthetic reasons. A conversion coating may be chromate based or non-chromate. Passivation of a galvanized metal surface by application of a conversion coating is done to provide corrosion resistance and for aesthetic reasons on materials which are not to be painted. A bulky, white corrosion product may form on an unprotected bright zinc surface when it becomes wet. This corrosion product is a mixture of zinc carbonate and zinc oxide or hydroxides resulting from zinc oxidation. The condition producing the "humid storage" stain (so-called white rust) most frequently occur in shipment and during storage especially when daily temperature variations cause atmospheric water vapor to condense on a zinc surface. Likewise, black stains form on unprotected Galvalume®. Galvalume® is a trademark for a zinc-aluminum galvanized coating over steel available from Bethlehem Steel Corporation.

Chrome based passivation treatments are applied to galvanized metals and Galvalume® to provide both long term and short term corrosion protection. A chromate treatment is typically provided by contacting galvanized metal with an aqueous composition containing hexavalent and trivalent chromium ions, phosphate ions and fluoride ions. Because of the high solubility and the strongly oxidizing character of hexavalent chromium ions, conventional chromate processes require extensive waste treatment procedures to control their discharge. In addition, the disposal of the solid sludge from such waste treatment procedures is a significant problem. As a result, non-chromate conversion coatings for passivation of galvanized metal surfaces have been developed. See for example, U.S. Pat. No. 5,344,505.

Prior art passivation treatments, chrome and non-chrome, typically provide adequate protection in less aggressive environments. However, prior art passivated galvanized metal exhibits less satisfactory performance in neutral salt fog atmospheres. In addition, prior art passivated galvanized metal surfaces usually have poor surface lubricity and fingerprint resistance.

SUMMARY OF THE INVENTION

The present invention comprises a composition and method for treating a galvanized metal surface to provide for passivation of the metal surface. The method and composition of the present invention enhances commercial passivation treatments. The present inventors discovered that the addition of a paraffin wax, preferably emulsified with nonionic surfactants, to commercial passivation treatments enhances the performance of the treatment. The treatment solution additive of the present invention can improve both chromium and non-chromium passivation treatments. The present invention improves the corrosion inhibiting properties of prior art passivation treatments. The present invention also improves the lubricity and fingerprint resistance of galvanized metal surfaces passivated with a passivation treatment including the treatment solution additive.

DETAILED DESCRIPTION OF THE PREFERRED EMBODIMENTS

The present inventors have discovered compositions and methods of improving passivation treatments for galvanized metals. As used herein, galvanized includes zinc galvanized metal as well as Galvalume®, a zinc-aluminum galvanized steel available from Bethlehem Steel.

The treatment of the present invention comprises adding to a non-chrome or chrome based galvanized metal passivation treatment a treatment solution additive comprising a paraffin wax solution. As used herein, passivation treatment refers to the chemical treatment of a metal surface to enhance corrosion resistance and/or surface appearance properties. Passivation treatments include but are not limited to chrome, non-chrome, phosphate and fluoro acid based metal treatments.

The paraffin wax can be emulsified with nonionic surfactants. The paraffin wax of the present invention preferably has a melting point of from about 90° to 200° F. The nonionic surfactants preferably employed to emulsify the paraffin wax preferably have HLB values from about 2 to 18. The nonionic surfactants can be a mixture of surfactants having different HLB values within this preferred range. The preferred treatment solution additive is an aqueous emulsified Wax solution containing 1–60% wt/wt paraffin wax most preferably 0.1–20% wt/wt paraffin wax and 1 to 20% wt/wt nonionic surfactants. The treatment solution additive is added to a conventional passivation treatment in amounts ranging from about 0.1% to about 20%. The modified passivation treatment can be applied to a galvanized surface using conventional application methods such as spin, spray, chem roller, or dip-squeegee.

When the metal surface being passivated will be heated during processing, it is desirable to add a heat resistant material to the modified passivation treatment of the present invention. For example if the metal surface being passivated will be heated to temperatures of about 400° F. or more, the addition of a heat resistant material can inhibit any degrative effect of such high temperatures. The heat resistant materials may comprise the use of water miscible solvents which have high boiling points and low vapor pressures in preparing the modified passivation treatment. In addition, it was discovered that the addition of an aqueous Teflon® (Teflon is a registered trademark of DuPont for tetrafluoroethylene fluorocarbon polymer) dispersion enhanced the heat resistance of the modified passivation treatment. The type of solvent selected or amount of Teflon dispersion added will depend on the peak metal temperatures encountered in the particular treatment line being employed.

The present inventors discovered that the addition of about 1 to 10% of a Teflon 30 or Teflon 30B available from DuPont dispersion to the treatment solution additive which will provide a 0.1 to 1% concentration in the modified passivation treatment prevented heat induced deterioration of the treatment even at peak metal temperatures of up to 450° F.

A typical treatment process employing the treatment solution additive of the present invention can include: cleaning the unpassivated galvanized metal or Galvalume® surface with an alkaline or weak acid cleaner followed by an ambient tap water rinse, squeegee, and applying a passivation treatment including the treatment solution additive of the present invention at room temperature. The cleaning and rinsing stages prior to passivation treatment application may not be necessary if the metal surface is not heavily soiled.

The present invention will now be further described with reference to a number of specific examples which are to be regarded as solely illustrative, and not as restricting the scope of the present invention.

EXAMPLES

The treatment solution additive of the present invention were tested on hot dipped galvanized metal and Galvalume® test panels. Comparative tests were run with a commercial chrome based passivation treatment and a commercial non-chrome passivation treatment as described in U.S. Pat. No. 5,344,505 which can include 0.5 to 50% phosphoric acid, 0.1 to 5% boric acid, and 0.1 to 5% molybdic acid (incorporated herein by reference). Commercial non-chrome passivation treatments are substantially free of chromium. That is, chromium is not added to the metal treatment although trace amounts may be present. The evaluation of the treatment solution additives of the present invention was carried out with a variety of accelerated corrosion testing, lubricity and fingerprint resistance measurements. The tests included:

"QCT": vapor continuously condenses on passivated panels and drips back into a hot (130° F.) water bath. The panels are checked periodically for the percent of area showing rust.

"Neutral salt spray" (NSS): passivated panels are placed in an NSS chamber (ASTM B117). Corrosion processes are monitored by determining both white and red rust. The percentage of area showing rust is measured.

"Friction coefficient": determined using Altek 9505A Lubricity Tester. A weighted test sled is pulled across a flat metal panel. The pulling force is used to calculate the friction coefficient.

"Fingerprint resistance": natural greasy fingers pressed on and stain marks observed. Rating of 1 is no visible stain, rating of 7 is easily observed finger marks.

EXAMPLE 1

After cleaning with an alkaline cleaner (3% Betz Kleen 4010 available from Betz Laboratories, Inc.) at 130° F. for 10 seconds, rinsing with ambient tap water for 5 seconds, and squeegeeing, ACT (Advanced Coating Technologies) G-90 hot dipped galvanized (HDG) test panels were spin coated with various passivation treatments as set out in Table 1. The results of QCT and neutral salt spray (NSS) testing are set forth in Tables II–V. In the tables the treatment concentrations were: 10% A; 2% B; 0.57% actives C; 0.28% actives D, E, F and G. In evaluating rusting, on galvanized surfaces white rust (WR) generally shows up before red rust (RR) and is considered less severe. On Galvalume dark rust (DR) is similar to white rust on galvanized surfaces.

TABLE I

| Treatment | Description |
|---|---|
| A | Non-chrome passivation treatment, in accordance with U.S. 5,344,505. |
| B | Hexavalent and trivalent chromium with phosphoric acid passivation treatment (available as Permatreat 2510 from Betz Laboratories). |
| C | Additive including paraffin wax (122–130° F. melting point) and a blend of a non-ionic surfactant (HLB 4.7) and nonionic surfactant (HLB 14.9) available as Trisco Tex CN from Scholler Inc. of Philadelphia, PA. |
| D | Additive including paraffin wax (131° F. melting point) and a blend of a nonionic surfactant (HLB 4.7) and a nonionic surfactant (HLB 14.9). |
| E | Additive including paraffin wax (130–135° F. melting point) and a blend of a nonionic surfactant (HLB 4.7) and a nonionic surfactant (HLB 14.9). |
| F | Additive including paraffin wax (140–145° F. melting point) and a blend of a nonionic surfactant (HLB 4.7) and a nonionic surfactant (HLB 14.9). |
| G | Additive including paraffin wax (160–165° F. melting point) and a blend of a nonionic surfactant (HLB 4.7) and a nonionic surfactant (HLB 14.9). |

TABLE II

| | QCT Performance on HDG Rust in QCT (%) | | | | |
|---|---|---|---|---|---|
| Treatment | 1 Day | 2 Day | 5 Day | 8 Day | 9 Day |
| A | — | — | — | 5 (WR) | — |
| A | — | — | 10 (WR) | — | 30 (WR) |
| A + C | — | — | — | 0 | — |
| B | — | — | — | 100 (WR) | — |
| B + C | — | — | — | 100 (WR) | — |
| A + D | 0 | 0 | 5 (WR) | — | 5 (WR) |
| A + E | 0 | 0 | 0 | — | 0 |
| A + F | 0 | 0 | 0 | — | 5 (WR) |
| A + G | 0 | 0 | 40 (WR) | — | 60 (WR) |
| A | — | — | — | 50 (RR) | — |
| A | 100 (WR) | 100 (WR) | 100 (WR) | — | 20 (RR) |
| A + C | — | — | — | 2 (RR) | — |
| B | — | — | — | 5 (RR) | — |
| B + C | — | — | — | 100 (WR) | — |

TABLE III

| | NSS Performance on HDG Rust in NSS (%) | | | | |
|---|---|---|---|---|---|
| Treatment | 1 Day | 2 Day | 5 Day | 6 Day | 9 Day |
| A + D | 100 (WR) | 100 (WR) | 100 (WR) | — | 30 (RR) |
| A + E | 100 (WR) | 100 (WR) | 100 (WR) | — | 2 (RR) |
| A + F | 100 (WR) | 100 (WR) | 100 (WR) | — | 20 (RR) |
| A + G | 100 (WR) | 100 (WR) | 100 (WR) | — | 50 (RR) |

TABLE IV

| | QCT Performance on Galvalume Rust in QCT (%) | | | |
|---|---|---|---|---|
| Treatment | 1 Day | 2 Day | 5 Day | 9 Day |
| A | 0 | 0 | 2 (DR) | 5 (DR) |
| A + D | 0 | 5 (DR) | 15 (DR) | 15 (DR) |
| A + E | 0 | 0 | 10 (DR) | 10 (DR) |

TABLE IV-continued

| Treatment | QCT Performance on Galvalume Rust in QCT (%) 1 Day | 2 Day | 5 Day | 9 Day |
|---|---|---|---|---|
| A + F | 5 (DR) | 5 (DR) | 15 (DR) | 15 (DR) |
| A + G | 0 | 0 | 5 (DR) | 30 (DR) |

TABLE V

| Treatment | NSS Performance on Galvalume Rust in NSS (%) 1 Day |
|---|---|
| A | 100 (DR) |
| A + D | 100 (DR) |
| A + E | 100 (DR) |
| A + F | 100 (DR) |
| A + G | 100 (DR) |

EXAMPLE 2

CFM (Chesapeake, Md.) electrogalvanized panels were cleaned with 3% Betz Kleen 4010 at 130° F. for 10 seconds, rinsed with ambient tap water for 5 seconds, squeegeed and treated by spin application with a variety of treatments. The panels were evaluated for lubricity. Table VI summarizes the test results.

TABLE VI

FRICTION COEFFICIENT

| Treatment | Additive | Friction Coefficient |
|---|---|---|
| 10% A | — | 0.39 |
| 10% A | 2% C | 0.07 |
| 2% B | — | 0.41 |
| 2% B | 2% C | 0.08 |

EXAMPLE 3

CFM electrogalvanized panels were cleaned as set forth in Example 2. Various concentrations of Treatment C with 10% Treatment A were applied by spin application. Fingerprint resistance of the treated surfaces was determined by pressing natural, greasy fingers against the panels and observing the resulting stain mark. Test panels treated with Treatment A exhibited easily observed finger marks (ranked #7), no visible stain was ranked #1.

TABLE VII

FINGERPRINT RESISTANCE

| C Conc. (%) in 10% A | Rank in Fingerprint Resistance* |
|---|---|
| 0.0 | 7 |
| 0.5 | 6 |
| 1.0 | 5 |
| 2.0 | 4 |
| 3.0 | 3 |
| 4.0 | 2 |
| 5.0 | 1 |

*The number indicates the fingerprint resistance performance rank. "1" = the best, "7" = the worst.

EXAMPLE 4

G60 hot dipped galvanized panels were cleaned with 3% Betz Kleen 4010 at 130° F. for 10 seconds, rinsed with ambient tap water, squeegeed and treated with 4% Treatment B plus 10% Treatment C. The modified passivation treatment (B+C) also included 1.0% Teflon suspensions or high boiling point solvents. Table VIII summarizes the results.

TABLE VIII

| Additive in Treatment B + C | Friction Coefficient No Heating | Friction Coefficient Heat to 450° F. |
|---|---|---|
| — | 0.04 | 0.60 |
| Teflon 30 | 0.04 | 0.13 |
| Teflon 30B | 0.04 | 0.12 |
| Pluacol E 400 | 0.07 | 0.32 |
| Maslip 504 | 0.07 | 0.31 |
| Phospholipid PTC | 0.08 | 0.27 |

Pluacol E 400 is a polyethylene glycol from BASF
Maslip 564 is a synthetic lubricant available from PPG Inc.
Phospholipid PTC is cocamidopropyl phosphatidyl PG - dimonium chloride available from Mona Industries, Inc.
Teflon 30 and 30B are available from DuPont While this invention has been described with respect to particular embodiments thereof, it is apparent that numerous other forms and modifications of the present invention will be obvious to those skilled in the art. The appended claims and this invention generally should be construed to cover all such obvious forms and modifications which are within the true spirit and scope of the present invention.

What is claimed is:

1. A process for passivating a galvanized metal surface with a substantially chromium free passivation treatment comprising including in said substantially chromium free passivation treatment from about 0.1% to about 20% by weight of a paraffin wax having a melting point of from about 90° to 200° F. and from about 1% to about 20% by weight of one or more nonionic surfactants having HLB values of from about 2 to about 18.

2. The process of claim 1 wherein said substantially chromium free passivation treatment comprises from about 0.5 to 50% by weight phosphoric acid, from about 0.1 to 5% by weight boric acid and optionally from about 0.1 to 5% by weight molybdic acid.

3. A process for passivating a galvanized metal surface with a substantially chromium free passivation treatment comprising including in said substantially chromium free passivation treatment from about 0.1% to about 20% by weight of a paraffin wax having a melting point of from about 90° to 200° F. and from about 1% to about 20% by weight of one or more nonionic surfactants having HLB values of from about 2 to 18 and about 0.1 to 1% by weight of a tetrafluoroethylene fluorocarbon polymer dispersion.

4. The process of claim 3 wherein said substantially chromium free passivation treatment comprises from about 0.5 to 50% by weight phosphoric acid, from about 0.1 to 5% by weight boric acid and optionally from about 0.1 to 5% by weight molybdic acid.

* * * * *